US008986473B1

(12) United States Patent
Kelley et al.

(10) Patent No.: US 8,986,473 B1
(45) Date of Patent: Mar. 24, 2015

(54) HIGH BURNING RATE TACTICAL SOLID ROCKET PROPELLANT, AND RELATED METHOD

(75) Inventors: John M. Kelley, Owings Mills, MD (US); Robert C. Gill, White Plains, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 1508 days.

(21) Appl. No.: 12/283,144

(22) Filed: Sep. 3, 2008

(51) Int. Cl.

| | |
|---|---|
| ***C06B 45/10*** | (2006.01) |
| ***C06B 25/00*** | (2006.01) |
| ***C06B 25/34*** | (2006.01) |
| ***C06B 45/00*** | (2006.01) |
| ***C06B 23/00*** | (2006.01) |

(52) U.S. Cl.
CPC ..... *C06B 23/004* (2013.01)
USPC ..... 149/19.3; 149/19.6; 149/19.9; 149/92

(58) Field of Classification Search
CPC ..... C06B 45/10; C06B 25/00; C06B 45/00; C06B 25/34
USPC ..... 149/19.3, 19.6, 19.9, 92
See application file for complete search history.

(56) References Cited

U.S. PATENT DOCUMENTS

| | | | | |
|---|---|---|---|---|
| 4,260,437 | A * | 4/1981 | Nakagawa et al. | 149/19.9 |
| 5,139,587 | A | 8/1992 | Strecker et al. | |
| 5,529,649 | A * | 6/1996 | Lund et al. | 149/19.3 |
| 6,562,159 | B2 | 5/2003 | Ampleman et al. | |
| 6,576,072 | B2 | 6/2003 | Chan et al. | |
| 6,632,378 | B1 * | 10/2003 | Wallace et al. | 252/182.24 |
| 6,682,614 | B1 | 1/2004 | Chan et al. | |
| 6,682,615 | B2 | 1/2004 | Chan et al. | |
| 6,783,614 | B1 | 8/2004 | Chan et al. | |
| 6,790,299 | B2 | 9/2004 | Chan et al. | |
| 6,905,561 | B2 | 6/2005 | Jones et al. | |
| 7,022,196 | B2 | 4/2006 | Cesaroni et al. | |
| 2003/0168139 | A1 * | 9/2003 | Chan et al. | 149/19.6 |

OTHER PUBLICATIONS

U.S. Appl. No. 12/283,145, filed Sep. 3, 2008, Kelley et al.

* cited by examiner

*Primary Examiner* — Aileen B Felton
(74) *Attorney, Agent, or Firm* — Fredric J. Zimmerman

(57) ABSTRACT

The invention is a composition for a high burning-rate solid rocket propellant, where the composition includes a binder compounded with a soluble energetic additive; a metallic fuel; and an oxidative fuel. The resulting composition has a tactical Class 1.3 hazard rating, and a linear regression rate that is substantially equivalent to a tactical Class 1.1 hazard rating obtainable using solid rocket propellants. The composition may include a heat-conducting element, a plasticizer, a curing component, a combustion catalyst, and curing catalyst.

14 Claims, 12 Drawing Sheets

HIGH BURNING RATE TACTICAL SOLID ROCKET PROPELLANT, AND RELATED METHOD

STATEMENT OF GOVERNMENT INTEREST

The invention described herein may be manufactured and used by or for the Government of the United States of America for Governmental purposes without the payment of any royalties thereon or therefore.

BACKGROUND OF THE INVENTION

The present invention relates generally to solid rocket propellants, and more particularly to solid rocket propellants, which have a burn rate that is normally only achievable with a Class 1.1 explosive, but have the safety of a Class 1.3 explosive.

A Class 1 explosive is any substance or article, including a device, which is designed to function by explosion (i.e., an extremely rapid release of gas and heat) or, which by chemical reaction within itself, is able to function in a similar manner even if not designed to function by explosion, unless the substance or article is otherwise classed under provision of 49 CFR 173.50. Class 1 explosives are divided into six divisions as follows: (1) Division 1.1 consists of explosives that have a mass explosion hazard. (2) Division 1.2 consists of explosives that have a projection hazard but not a mass explosion hazard. (3) Division 1.3 consists of explosives that have a fire hazard and either a minor blast hazard or minor projection hazard or both, but not a mass explosion hazard, that is, a mass non-detonable hazard rating. Classes 1.4-1.6 are slower burning explosives and are not suitable for rocket propellants.

A need exists for extending the linear burning-rate of tactical (i.e., Class 1, Division 3, or Class 1.3) composite solid rocket propellants for standard ship-borne missiles. The control of burning rate may be viewed as an aspect of energy management, or how the energy initially stored within the solid-propellant charge is allowed to be released. Simplistically, the thrust, F, delivered by a rocket may be expressed as:

$$F=(dm/dt)\times U_e, \text{ where } dm/dt=\rho rS, \text{ and } U_e=I_{sp}\times g_c$$

where dm/dt is the mass evolved by the burning propellant charge per unit time, $U_e$ is the rocket's exhaust velocity, ρ is the solid propellant density, r is the propellant linear burning-rate, S is the total burning surface area of the solid charge, $I_{sp}$ is the propellant specific impulse (which may be thought of as its energy content per unit mass), and $g_c$ is the gravitational constant. As the quantities ρ, r, and $I_{sp}$ are intrinsic properties of any solid-propellant composition, one might conclude that a rationale for this need is to increase the volumetric loading of next-generation solid-rocket combustors (i.e., they will become increasingly volume-limited). Hence, energy management (dm/dt, for example) via extrinsic means (e.g., burning surface, S) will become unavailable. A complication is that for current technology compositions (i.e., AP, Al and inert hydrocarbon binder), the chemical kinetics of combustion limits the surface-regression-rate to about 12 mm/sec (0.5 in/sec) at 1,000 psi. Catalytically-accelerated decomposition has been observed to raise this regression rate to 25 to 50 mm/sec (1 to 2 in/sec) at 1,000 psi in some cases, albeit with an increase in hazards (e.g., friction and/or impact). Most notable are with Fe-based liquid Catocene® or ultra-fine solid NanoCat® $Fe_2O_3$). However, rates of 125 to 150 mm/sec are cited for the current need.

Such regression-rates have been demonstrated and exceeded in high-energy solid rocket propellants for interceptors (e.g., Sprint, Hibex). However, to achieve both the requisite energy-densities and regression-rates, such propellants, based upon cast composite-modified double-base technology, present mass-detonable (i.e., Class 1 Division 1, or 1.1), and Safety-Life (i.e., long-term life chemical stability) issues. Their hazards when subjected to unplanned insult (e.g., enemy fire) will also be unacceptable for ship-borne ordnance applications. Hence, it will be necessary to maintain a 1.3 hazard classification.

A need exists for a propellant that achieves a burn rate, historically, only attainable using a mass-detonable propellant (e.g., a Class 1 Division 1, or 1.1 explosive). Further, a need exists for a propellant that still meets the Safety-Life (i.e., long-term life chemical stability) acceptable for ship-borne ordnance applications, which heretofore have only been obtainable with propellants classified as a Class 1 Division 3, or 1.3 explosive.

Further, a method is needed for developing a composition of a non-mass-detonable propellant that is highly energetic (where a mass-detonable propellant is a Class 1 Division 1, or 1.1 explosive) and yet meets the Safety-Life (i.e., long-term life chemical stability) acceptable for ship-borne ordnance applications, which is a Division 1.3 hazard classification.

SUMMARY OF THE INVENTION

An aspect of the invention is a composition for a high burning-rate solid rocket propellant, and a method for developing the composition. The composition is a rocket propellant including a binder that is compounded with a soluble energetic additive. The binder is selected to not only impart physical integrity to the solid rocket propellant, but also to solubilize the energetic additive, to add energy to the propellant, to be an effective binder at relatively low percentages of the total composition, to have high linear regression burning rates, and to be relatively stable over a wide temperature range. The composition is not so energetic as to cause a change in classification. The binder may include one or more polymers, and if an energetic polymer, such as BAMO/AMMO, is employed, it may only be used at levels that do not shift the hazard rating.

In an aspect, the composition includes an elastomeric polymeric binder compounded with a soluble energetic additive, a metallic fuel, and an oxidative fuel, where the composition has a tactical Class 1.3 hazard rating, and a linear regression rate that is conventionally only obtainable using solid rocket propellants having a tactical Class 1.1 hazard rating. In an embodiment, the elastomeric binder is a relatively polar polymer. The polarity increases the capability to solubilize energetic additives, as most energetic additives include nitrogen or oxygen or both, and compounds including these atoms are generally polar molecules.

In another aspect, the invention is also a method for developing a composition for a solid rocket propellant fuel having a tactical Class 1.3 hazard rating, and a linear regression rate that is conventionally only obtainable using solid rocket propellants having a tactical Class 1.1 hazard rating. The method includes selecting at least one binder having good solubility for an energetic additive; preparing a composition of a solid rocket propellant based on empirically predicted burn rates; measuring the burn-rates; optimizing the compositions burn-rate by making the binder more thermally-responsive; and confirming that the composition still meets the tactical Class 1.3 hazard rating.

DETAILED DESCRIPTION OF EXEMPLARY EMBODIMENTS OF THE INVENTION

Figure 2:
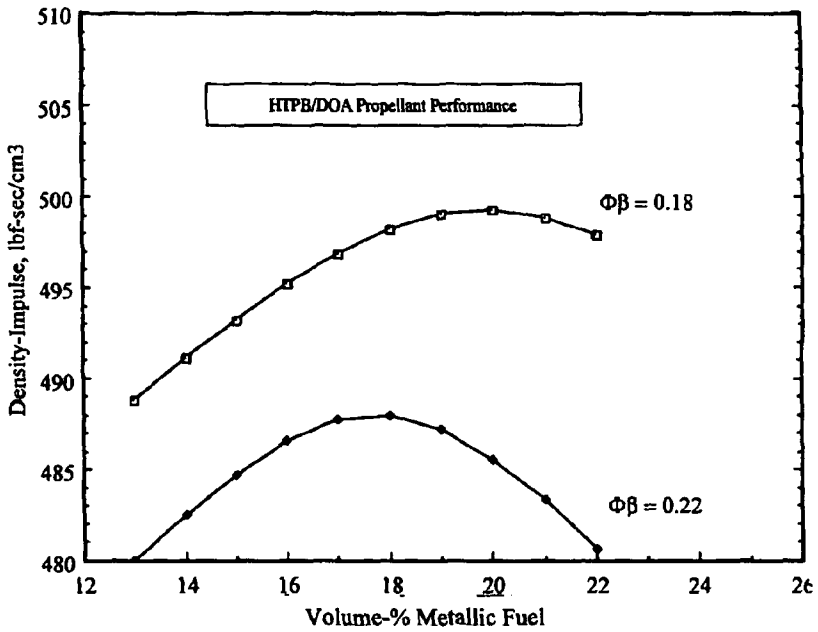
FIG. 1 and FIG. 2 are graphs of baseline ammonium perchlorate (AP)/aluminum (AL) propellant composition with binder HTPB/DOA/IPDI at two volume-% concentration levels, 18% and 22%, predicting, respectively, the specific-impulse (force*time/mass) and the density-impulse (force*time/volume) as a function of the volume-percent of metallic fuel.
Figure 1:
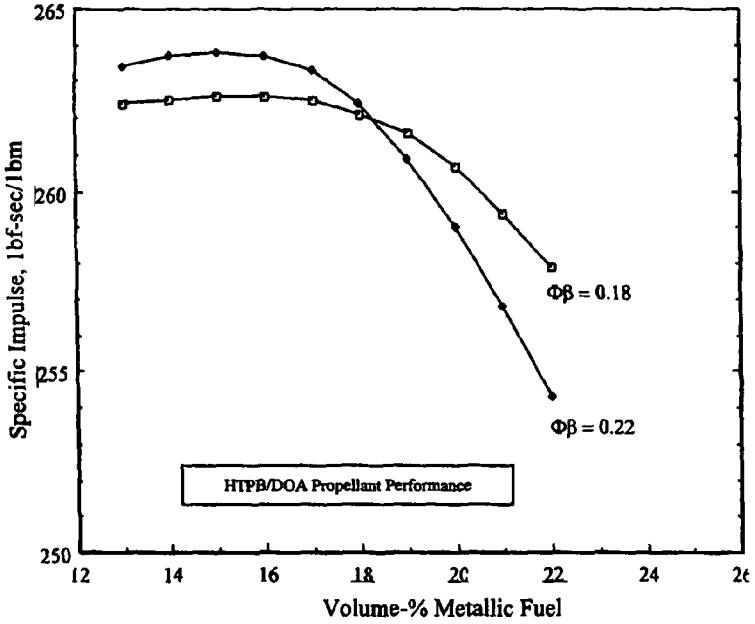
Figure 3:
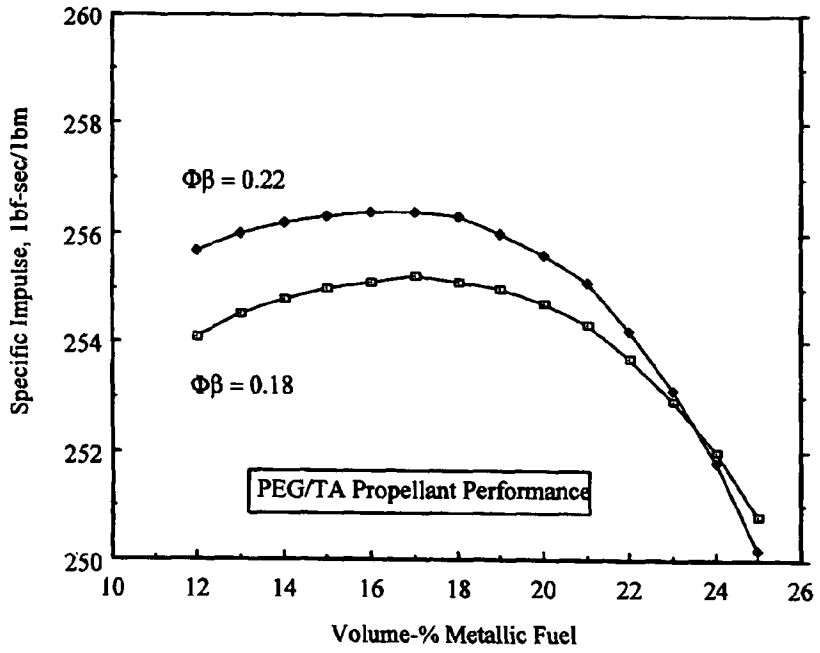
FIG. 3 and FIG. 4 are graphs of the ammonium perchlorate (AP)/aluminum (AL) propellant composition with binder PEG, TA, CL-20 and IPDI at two volume-% concentration levels, 18% and 22%, predicting, respectively, the specific-impulse (force*time/mass) and the density-impulse (force*time/volume) as a function of the volume-percent of metallic fuel.
Figure 4:
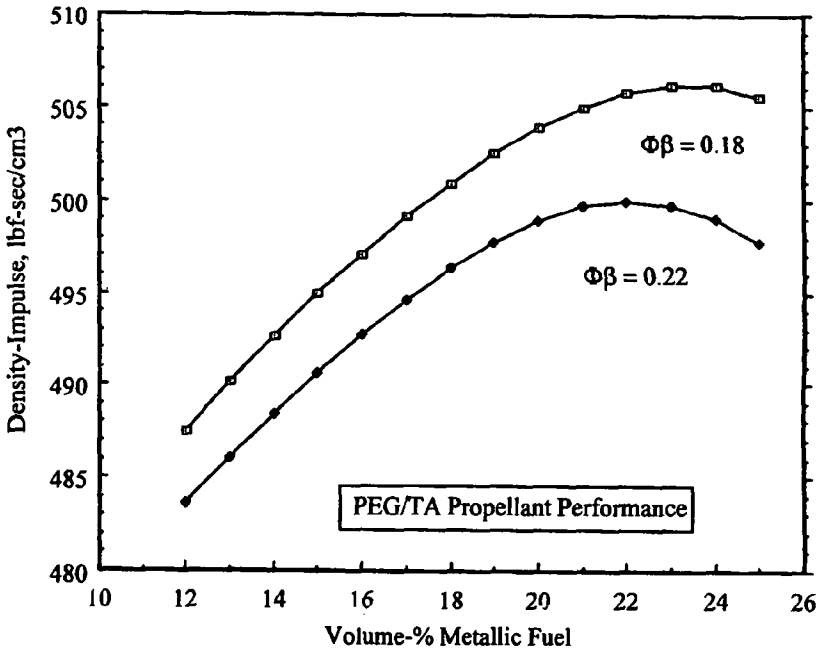
Figure 6:
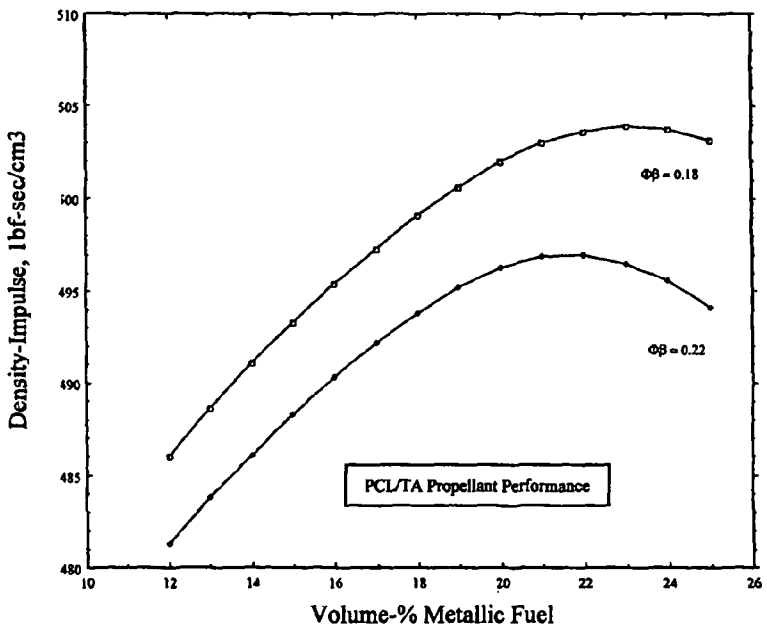
FIG. 5 and FIG. 6 are graphs of the ammonium perchlorate (AP)/aluminum (AL) propellant composition with binder HTPE, TA, CL-20 and IPDI at two volume-% concentration levels, 18% and 22%, predicting, respectively, the specific-impulse (force*time/mass) and the density-impulse (force*time/volume) as a function of the volume-percent of metallic fuel.
Figure 5:
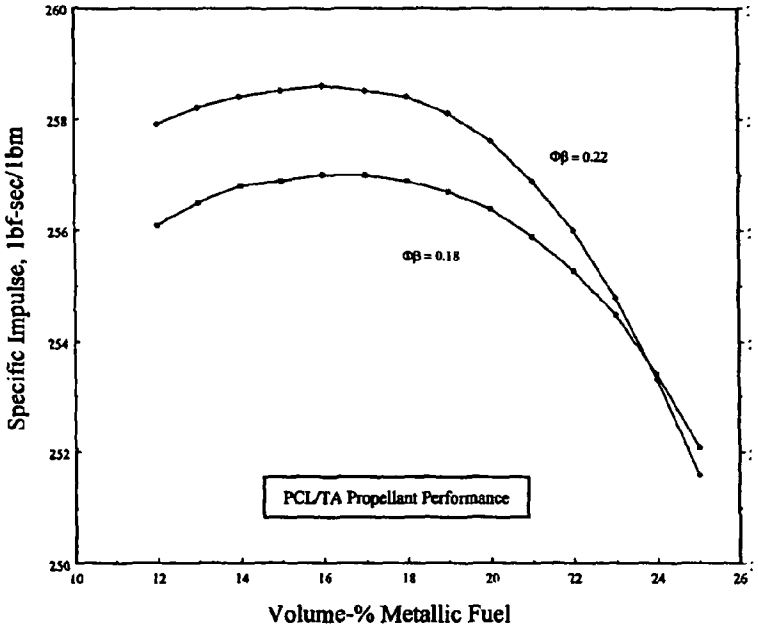
Figure 8:
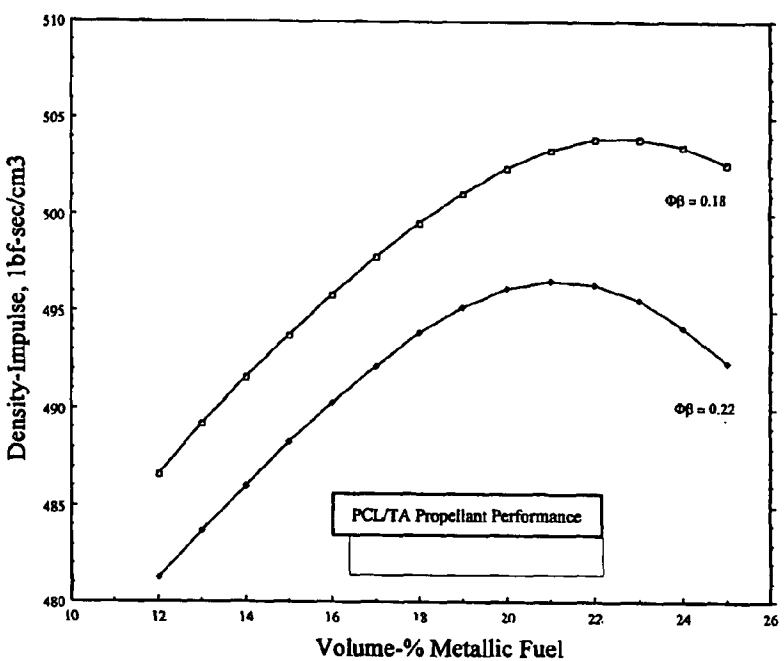
FIG. 7 and FIG. 8 are graphs of the ammonium perchlorate (AP)/aluminum (AL) propellant composition with binder PCL, TA, CL-20 and IPDI at two volume-% concentration levels, 18% and 22%, predicting, respectively, the specific-impulse (force*sec/mass) and the density-impulse (force*time/volume) as a function of the volume-percent of metallic fuel.
Figure 7:
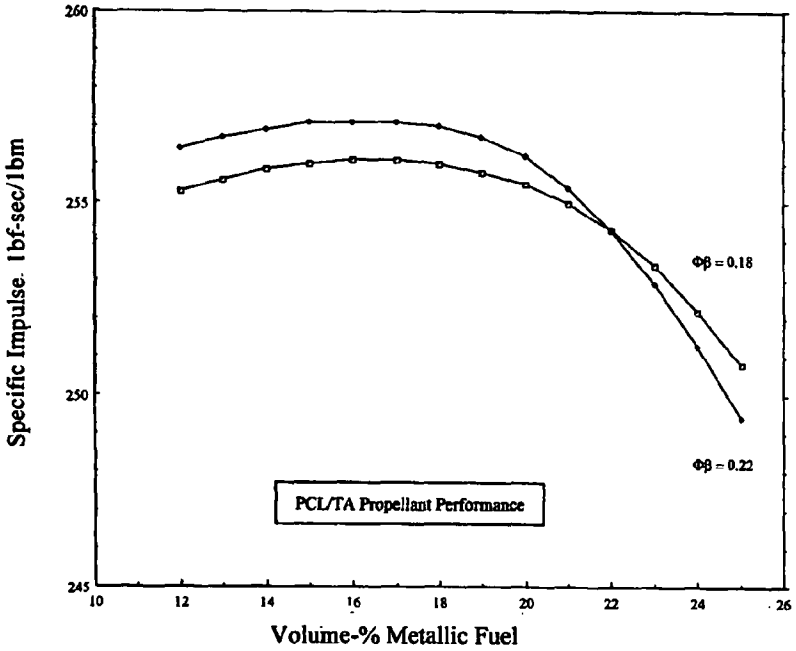
Figure 9:
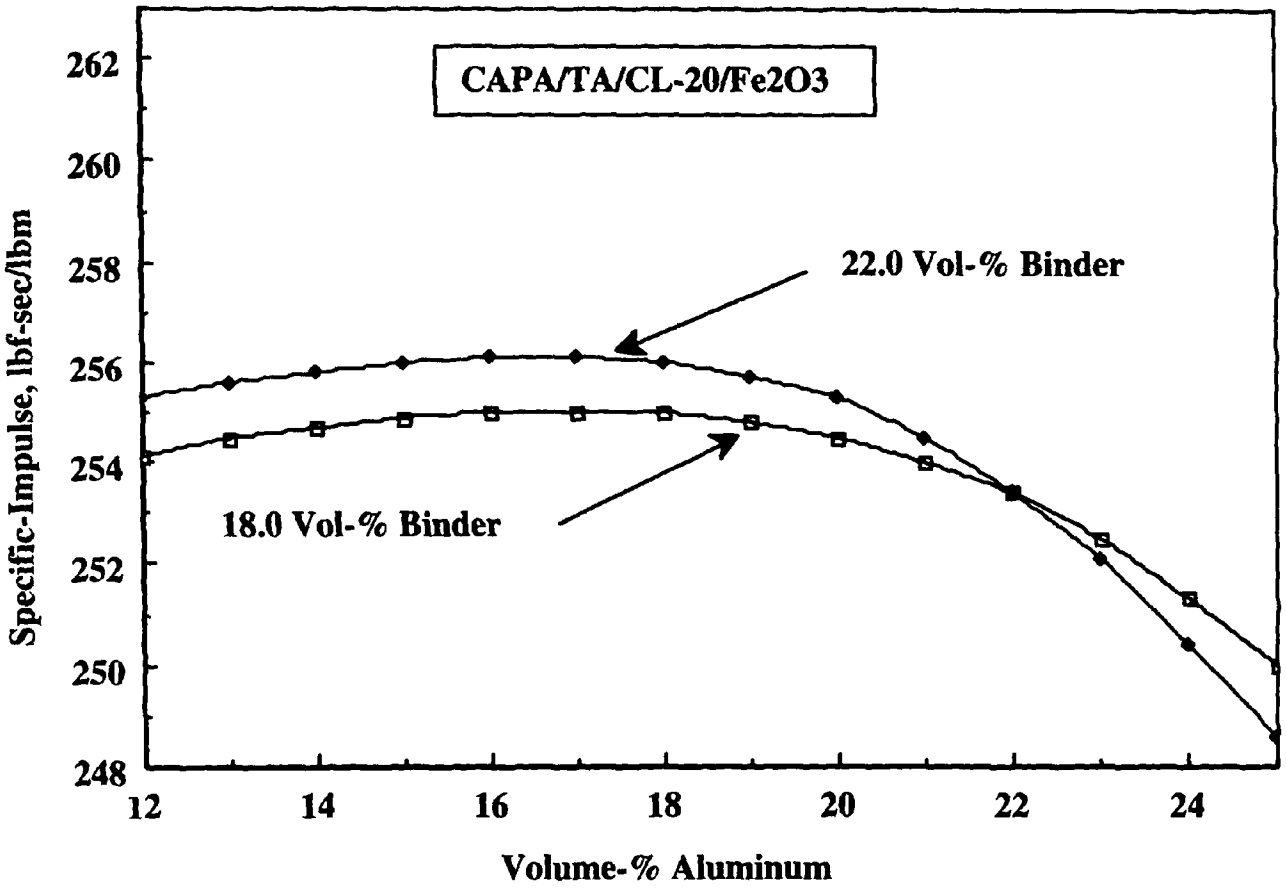
FIG. 9 are Iso-plots of $Fe_2O_3$-Catalayzed CAPA/CL-20 (Isp) at two volume % concentration levels, 18.0 Vol-% Binder and 22.0 Vol-% Binder.
Figure 10:
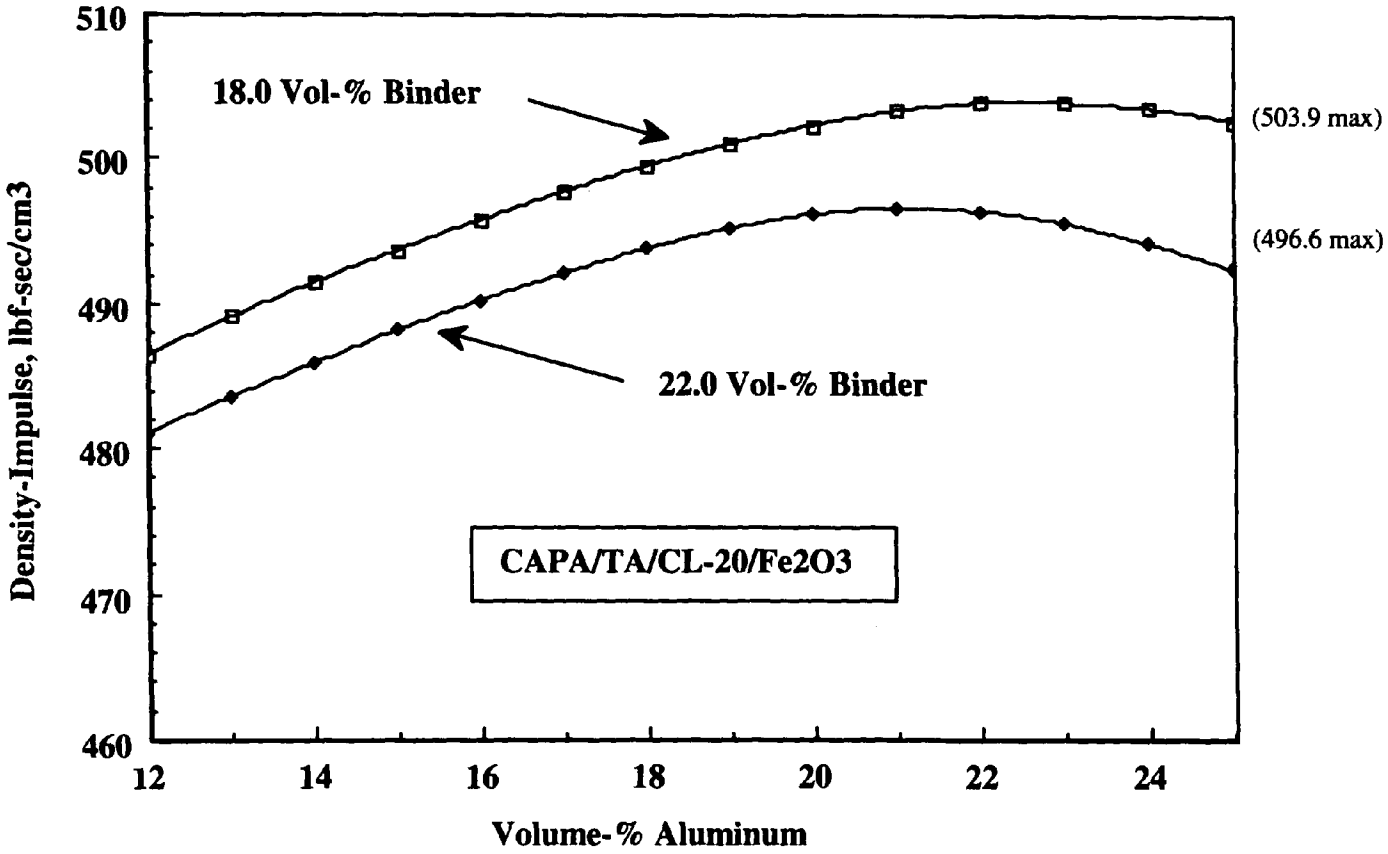
FIG. 10 are Iso-plots of $Fe_2O_3$-Catalayzed CAPA/CL-20 (ρ×Isp) at two volume % concentration levels, 18.0 Vol-% Binder and 22.0 Vol-% Binder.
Figure 11:
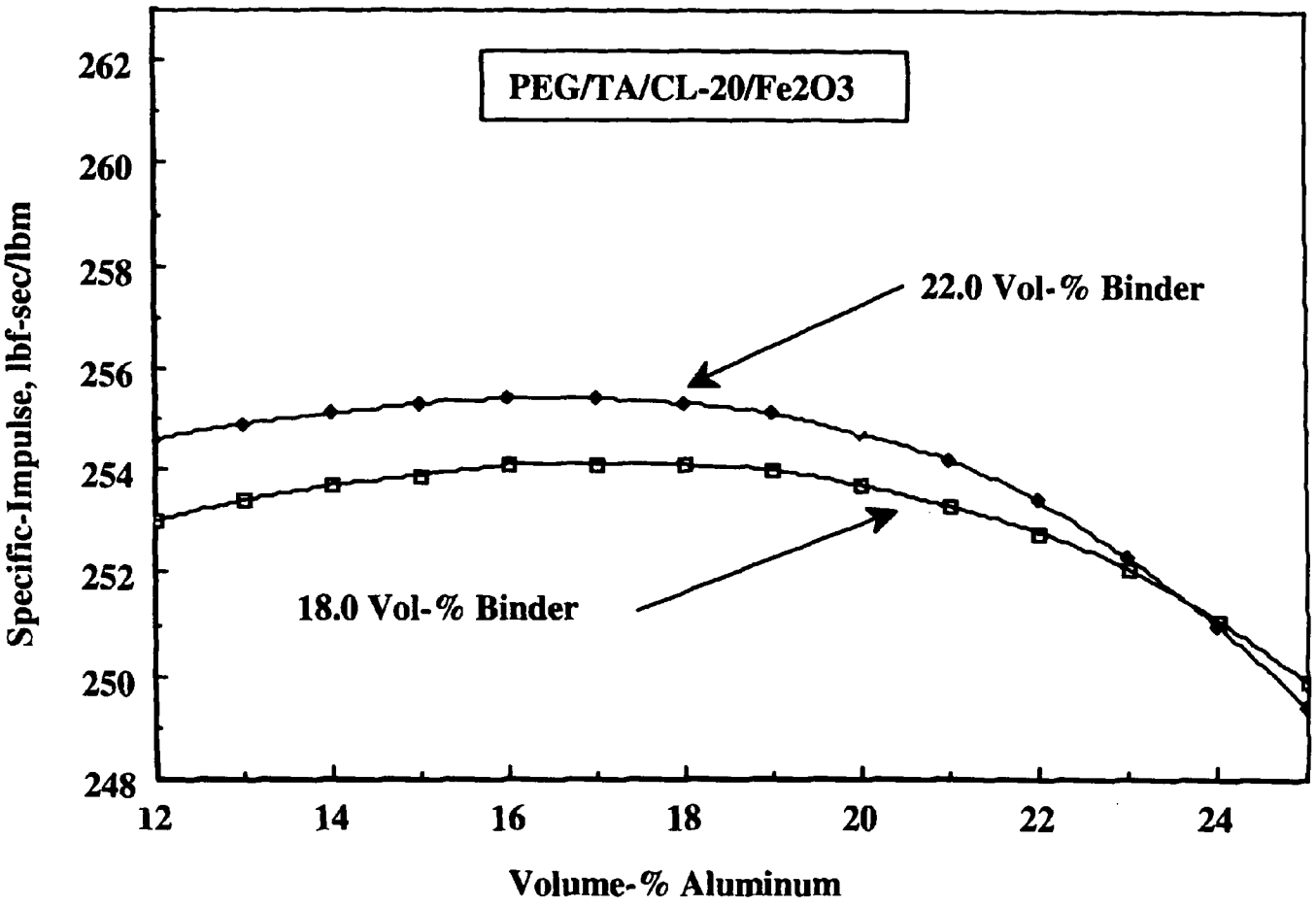
FIG. 11 are Iso-plots of $Fe_2O_3$-Catalayzed PEG/CL-20 (Isp) at two volume % concentration levels, 18.0 Vol-% Binder and 22.0 Vol-% Binder.
Figure 12:
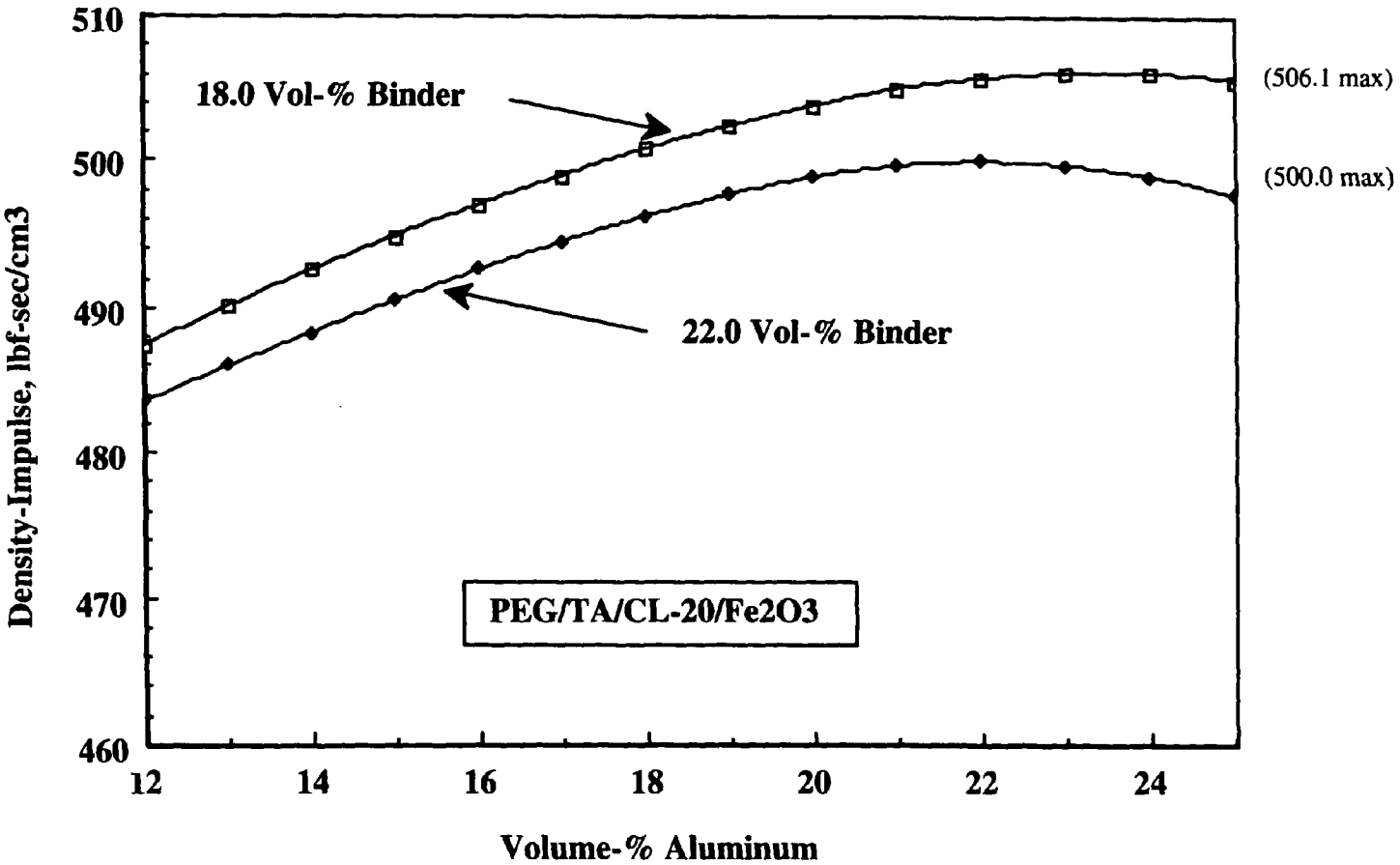
FIG. 12 are Iso-plots of $Fe_2O_3$-Catalayzed PEG/CL-20 (ρ×Isp) at two volume % concentration levels, 18.0 Vol-% Binder and 22.0 Vol-% Binder.
Figure 13:
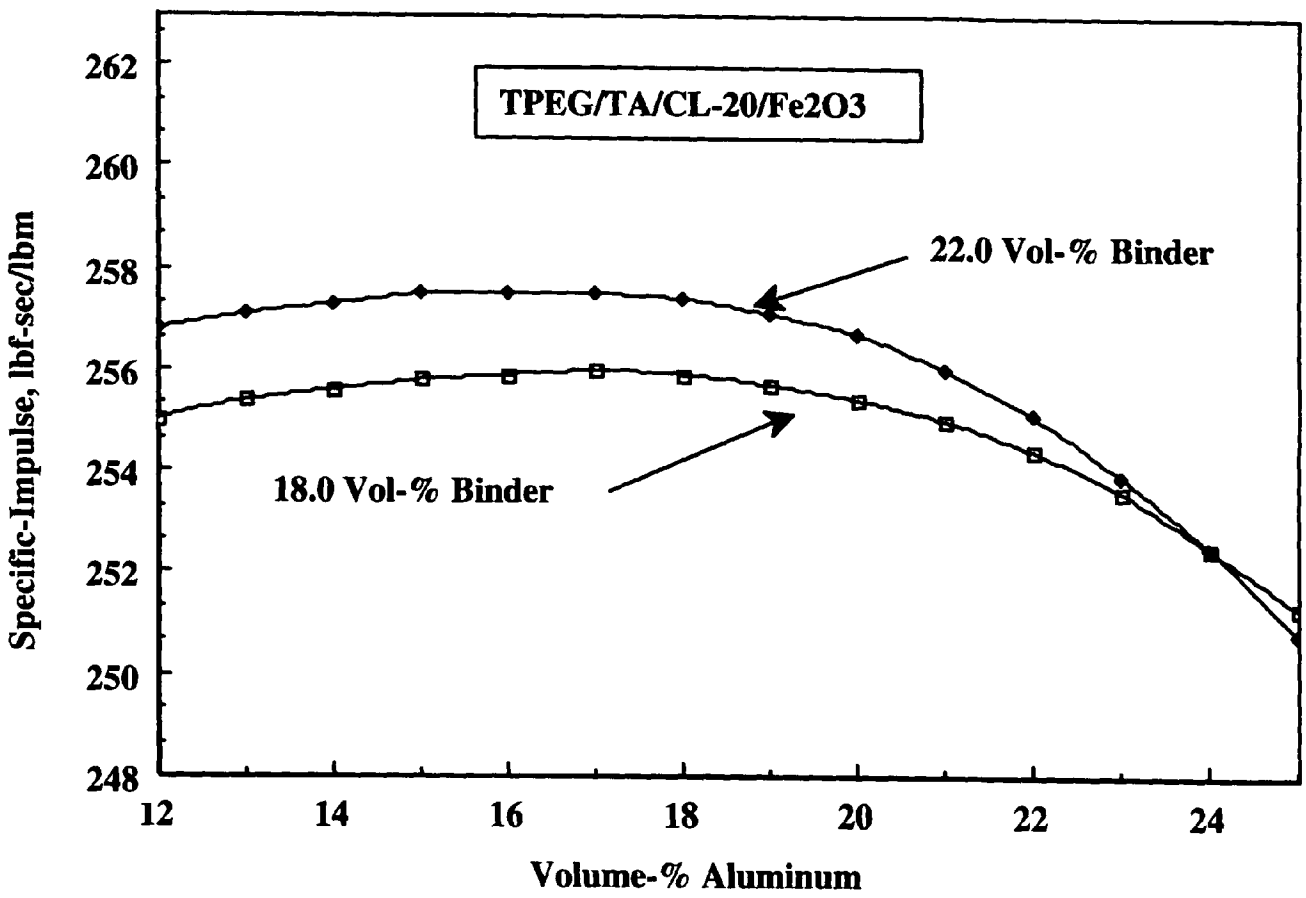
FIG. 13 are Iso-plots of $Fe_2O_3$-Catalayzed TPEG/CL-20 (Isp) at two volume % concentration levels, 18.0 Vol-% Binder and 22.0 Vol-% Binder.
Figure 14:
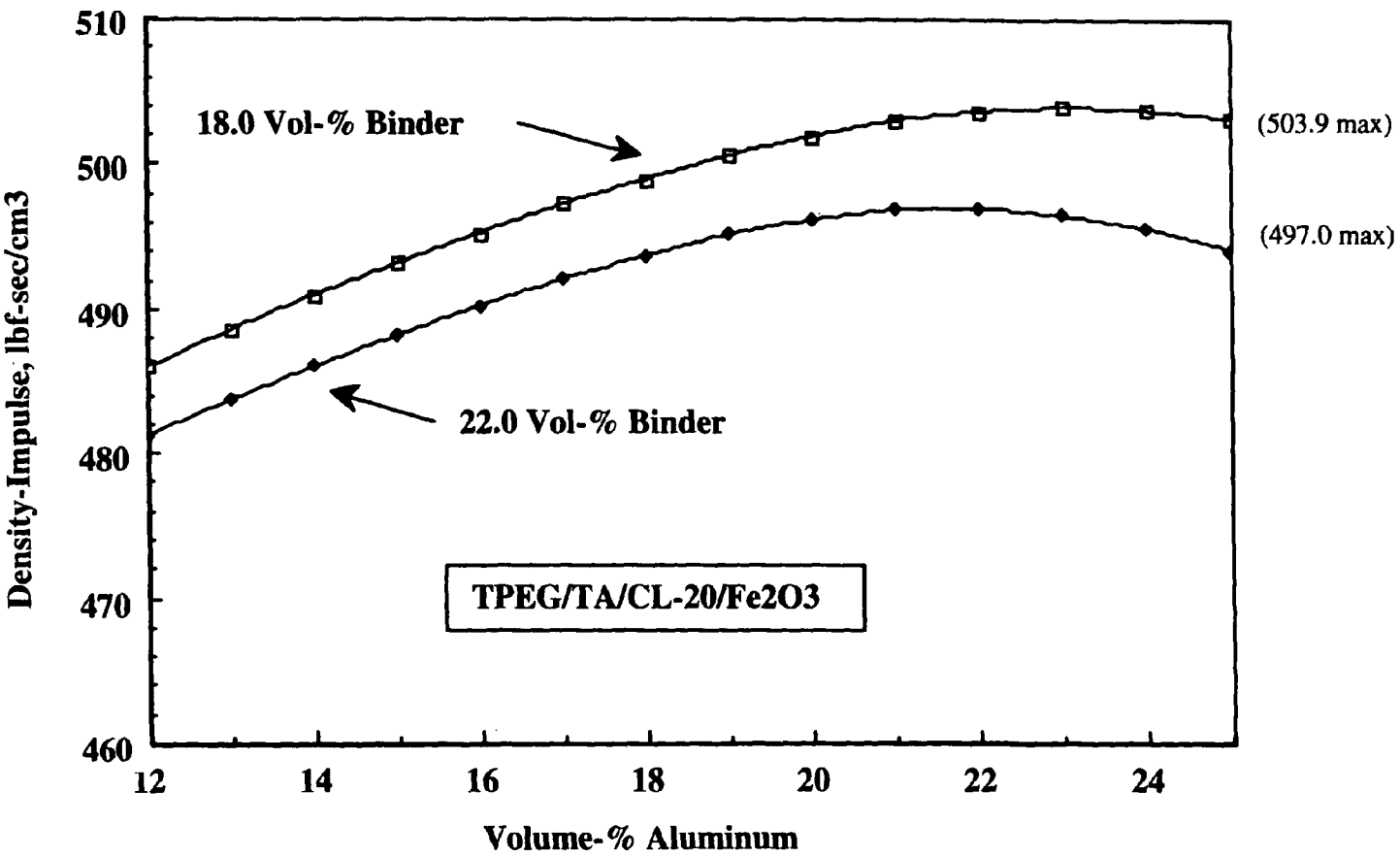
FIG. 14 are Iso-plots of $Fe_2O_3$-Catalayzed TPEG/CL-20 (ρ×Isp) at two volume % concentration levels, 18.0 Vol-% Binder and 22.0 Vol-% Binder.
Figure 15:
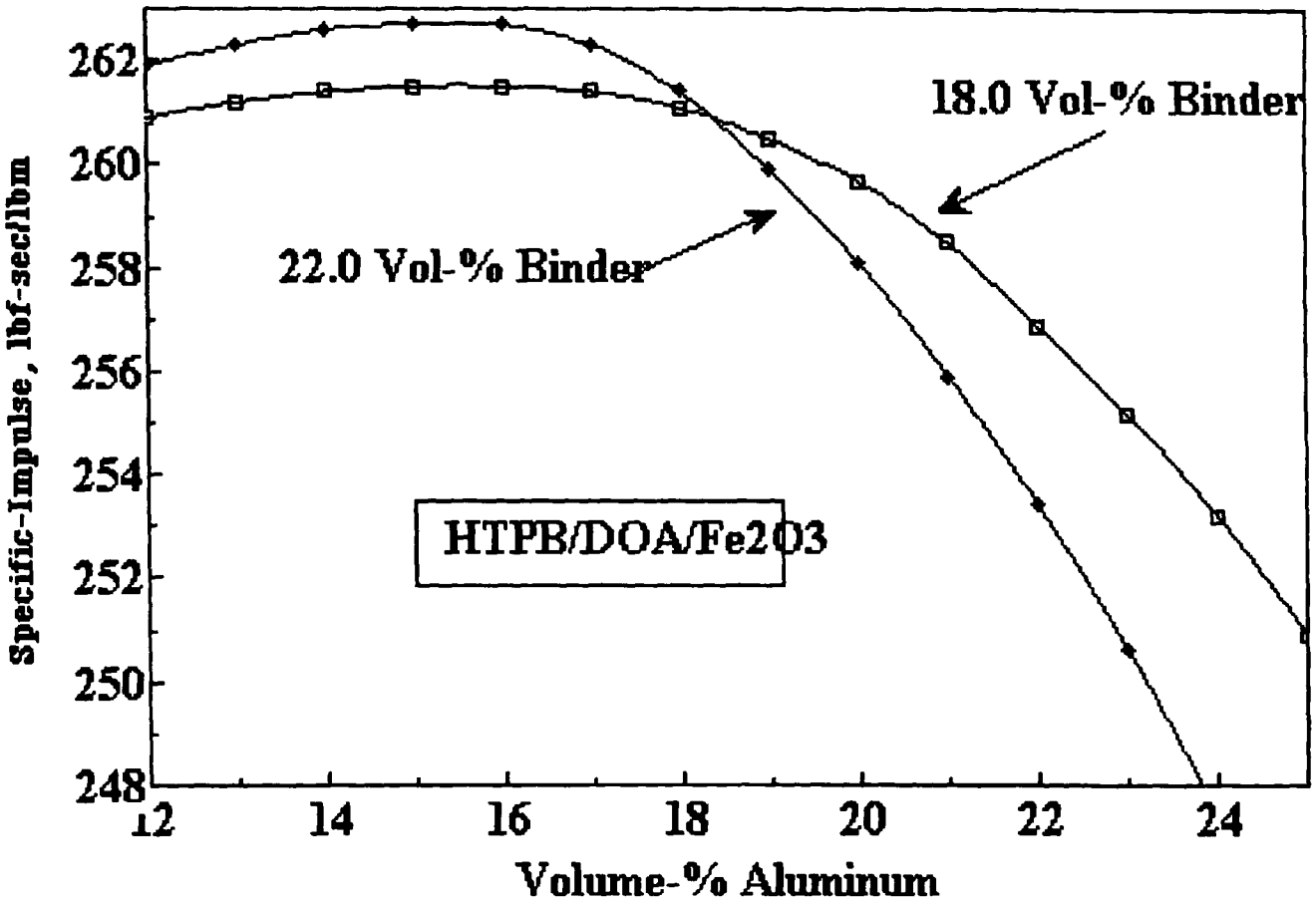
FIG. 15 are Iso-plots of $Fe_2O_3$-Catalayzed HTPB/DOA (Isp) at two volume % concentration levels, 18.0 Vol-% Binder and 22.0 Vol-% Binder.
Figure 16:
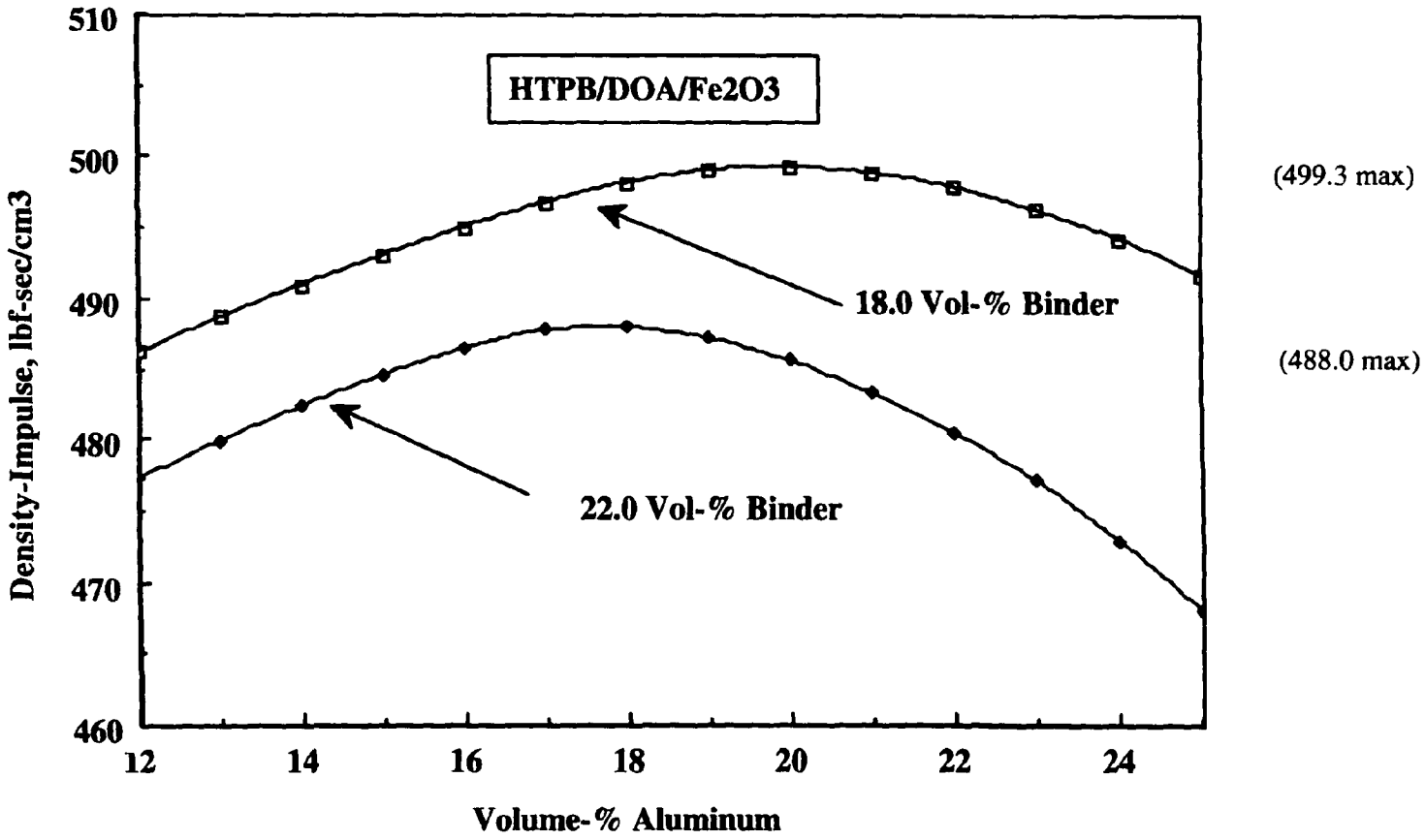
FIG. 16 are Iso-plots of $Fe_2O_3$-Catalayzed HTPB/DOA (ρ×Isp) at two volume % concentration levels, 18.0 Vol-% Binder and 22.0 Vol-% Binder.

The composition includes an elastomeric polymeric binder compounded with a soluble energetic additive, a metallic fuel, and an oxidative fuel, where the composition has a tactical Class 1.3 hazard rating, and a linear regression rate that is conventionally only obtainable using solid rocket propellants having a tactical Class 1.1 hazard rating. The binder is selected from the group including polar polymers: polyesters (such as, HTPCL, hydroxyl terminated polycaprolactones and polycaprolactone-containing copolymers (such as, CAPA)), and HTPE (hydroxyl terminated polyethers (such as PEG (polyethylene glycol), (PPG) polypropylene glycol, (PTMG) polytetramethylene glycol, (PIBG) polyisobutylene glycol, and (PBG) polybutylene glycol, polymeric combinations of glycols, and blends thereof)). The binders are generally admixed with a plasticizer like TA (triacetin), DOP (dioctyl phthalate), DOA (dioctyladipate), DOM (dioctylmaleate), DBP (dibutylphthalate), and adiponitrile. The binders may be cured with monomeric diisocyanates or polymeric isocyanates or other suitable curing agent. Examples of curing agents, without limitations, are: difunctional materials, such as, IPDI (isophorone diisocyanate), HDI (hexamethylene diisocyanate), and DDI (dimeryl diisocyanate); and polyfunctional Bayer Desmodur® N-100, which is a biuret made from HDI. Additional curing agents may be used if the functional group on the polymers is carboxyl, for example, bisphenol-A epoxy resin. CAPA copolymers are manufactured by Solvay Interox®, Inc. The binders compounded with alkyl nitro compounds, such as, CL-20, are more stable than the binders classified as "energetic binders". For instance, Morton Thiokol offers an energetic binder called BAMO/AMMO, which is the thermoplasticblock copolymer of polyoxetanes. BAMO/AMMO is melted at moderately elevated temperature and solidified into an elastomeric material. It is made from two types of monomers: 3,3-bis-azidomethyl-oxetane, or BAMO as a hard block, and 3-azidomethyl-3-methyloxetane, or AMMO as a soft block. BAMO/AMMO is less stable than the invented binder, and the resulting propellant based on BAMO/AMMO is generally classified as a 1.1 explosive.

In an embodiment, the soluble energetic additive is selected from the group of CL-20 (hexanitrohexaazaisowurtzitane), octanitrocubane, RNX (hexahydrotrinitrotriazine), RDX (hexahydro-1,3,5,-trinitro-1,3,5,-triazocine), ADN (ammonium dinitramide), ADNAZ. (N-acetyl-3,3-dinitroazetine), TNAZ (1,3,3-trinitroazetidine). Combinations of these energetic materials also may be used.

Other energetic additives, like nitroplasticizers, such as nitrate esters (i.e., BTTN (butane-trio-trinitrate), TMETN (trimethylolethane trinitrate), TEGDN (triethylene glycol dinitrate), BDNPA/F (bis 2,2-dinitro propyl acetal/bis 2,2-dinitro propyl formal) or mixtures thereof fall into the Division 1.1, and do not meet the Safety-Life criteria for shipborne applications, and are therefore unacceptable. In an embodiment, the energetic additive is CL-20.

In an embodiment, the metallic fuels are selected from the group of aluminum, iron, magnesium, zinc, boron, tungsten, zirconium, titanium, copper, chromium, molybdenum metal oxides, hydrides, or mixtures thereof. Aluminum is generally the most common.

The composition can furthermore include heat-conducting elements, where the elements are selected from the group consisting of whiskers, wires, staples, spheres, flakes, and nano-phase particles. These heat-conducting elements mechanistically transfer heat from the burning surface of the regression layer to the underlying layer of the solid rocket propellant, acting to preheat the propellant so that it is closer to its activation temperature. The transfer mechanism utilizes conduction, which is more efficient than conventional tactical solid propellants that essentially rely on radiation and convection, and very little conduction. The heat-conducting elements act like heat-conducting antennas, which reach into, or close to, the flame and conduct heat below the burning surface, thereby involving a greater volume of propellant per unit of time in the decomposition process preliminary to ignition and burning. Some of the metallic fuel itself can also have a similar shape. In essence, both the metallic fuel and the conducting elements serve as fuels.

In an embodiment, an oxidative fuel is AP (ammonium perchlorate), and a metallic fuel is aluminum, where the aluminum is finely divided and includes a high surface area.

The composition of the high burning-rate solid rocket propellant may further include cure catalysts, such as, dibutyltin diacetate, dibutyltin dilaurate, triphenyl bismuth, and ferric acetylacetonate.

The composition may additionally include a combustion catalyst, which facilitates burning, where the combustion catalyst is one of the generally catalysts used with AP type of propellants, such as, an iron oxide or an exotic iron-ferrocene compound (I.e., bis-ethyl ferrocenyl propane). Compounds, such as, bis-ethyl ferrocenyl propane may additionally function as a combustion catalyst and a fuel.

The high burning-rate solid rocket propellant may further include additional additives that are found in a fully formulated rocket fuel propellant, including stabilizers (i.e., antioxidants), bonding agents, processing agents (i.e., lubricants), opacifiers, and colorants to illustrate, visually, homogeneity.

A benefit of the higher regression-rate is that less highly-convoluted propellant surface-to-volume relationships are required for achievement of motor energy-management design parameters. The higher regression-rate largely minimizes or eliminates the need for stress-concentrating geometric propellant charge features, and ensures a longer rocket motor service-life.

In an embodiment, a method of developing a composition for a solid rocket propellant increases the linear regression rate that approaches the tactical Class 1.1 solid rocket propellants via a multi-variant, systems-oriented approach while maintaining a Class 1.3 safety rating. The method may include selecting at least one binder having good solubility for an energetic additive; preparing a composition of a solid rocket propellant based on empirically predicted burn rates; measuring the burn-rates; optimizing the compositions burn-rate by making the binder more thermally-responsive; and confirming that the composition still meets the tactical Class 1.3 hazard rating. Additionally, the method may include theoretically evaluating intrinsic performance characteristics by calculating the specific-impulse and the density-impulse as a function of binder type, binder composition, percent binder and percent fuel; as well as testing and measuring samples to confirm that the theoretical intrinsic performance characteristics are predictive of actual results. In addition, parameters of interest for systems-optimization may include propellant combustor-chamber temperature, nozzle-throat gas temperature, propellant density, nozzle exit-plane temperature, exhaust species, and others. The method can include optimizing the composition for a volume-limited motor or a weight-limited motor (e.g., an upper-stage) as an appropriate performance figure of merit for selection. Additionally, the method may incorporate known empirical parameters, such as, compatibility, shock and thermal stability, environmental and health issues, and rheological properties of the propellant and/or binder in its uncured and cured states to eliminate certain combinations. For example, HTPB (hydroxy terminated polybutadiene) is a relatively non-polar binder as compared to PEG, and nitramine compounds (I.e., CL-20) are soluble in PEG, but not in HTPB. Some isocyanate cure additives, such as, TDI (toluene diisocyanate), are highly toxic to humans, and are more hazardous than other materials, such as, IPDI.

The method may include optimizing the composition for a volume-limited motor or a weight-limited motor as an appropriate performance figure of merit for selection. This optimization may be quantified, for example, on the basis of the theoretical burn-out velocity ($V_{BO}$) of a rocket or missile of interest while employing various parametrically-varied candidate propellant compositions. Further compositional tailoring may follow.

State-of-the-art tactical solid rocket propellants that are approved for shipboard use must meet a Class 1.3 hazard rating. Many of these propellants utilize a composition include a binder, such as, HTPB, which is a metallic fuel, that is, an aluminum powder, and a solid oxidizer, such as, AP. Generally, the HTPB binder is plasticized with a plasticizer like DOA. High-energy plasticizers, such as, nitro esters, are too hazardous to be employed as there is a heat and shock danger, for instance, if the vessel was hit by incoming ordnance or there was some onboard explosion. The nitramine compounds, such as, CL-20, are stable for use but are only minimally soluble in HTPB binder, which is relatively non-polar. In an embodiment, identified binder systems are compatible with soluble energetic additives, such as, alkyl nitro compounds, for example, CL-20.

Referring to Table 1, PEG-8000, which is a polyethylene glycol ~8000 g. mol. wt., was combined with TA (triacetin), and CL-20, where the CL-20 dissolved and comprised 20.6% by weight of the binder. HTPE was combined with TA and CL-20, where the CL-20 dissolved and comprised 14.6% by weight of the binder. Polycaprolactone (PCL) was combined with TA and CL-20, where the CL-20 dissolved and comprised 16.4% by weight of the binder. The R-45M is the backbone polymer in an HTPB, and was combined with DOA (dioctyladipate) and CL-20 but only dissolved a small percentage of CL-20 (3.2%). The calculated heat-of-explosion and density data (actual data) are given in the Table 1.

TABLE 1

| | Wt-% CL-20 | cal/cm$^3$ | g/cm$^3$ |
|---|---|---|---|
| PEG-8000/TA/CL-20 | 20.6 | 758 | 1.279 |
| HTPE/TA/CL-20 | 14.6 | 736 | 1.163 |
| HTPE/TA | 0.0 | 612 | 1.084 |
| PCL/TA/CL-20 | 16.4 | 602 | 1.212 |
| PCL/TA/CL-20/AP | 16.4 | 616 | 1.218 |
| R-45M/DOA/CL-20 | 3.2 | 408 | 0.930 |

As can be observed, small to medium proportions of a non-nitro-ester, additives (e.g., CL-20) rapidly increase the binder energy, while avoiding Safety-Life implications that attend, for example, the decomposition of nitrate esters. Note: HTPE/TA with and without CL-20. An addition of 14.6% CL-20 increased the combustion energy from 612 to 736 cal/cm$^3$, an increase of 20%. The addition of AP in the HTPE/TA/CL-20 binder did not result in "salting-out" of the CL-20. All the compositions had an acceptable or moderate sensitivity to Drop-Weight Impact, Sliding-Friction and Electrostatic Discharge, and hence could be handled safely. Differential-Scanning calorimetry did not find any evidence of chemical incompatibility.

FIGS. 1 through 8 present general parametric thermo-chemical performance trades (i.e., specific-impulse and density-impulse vs. volume-% metallic fuel and volume-% binder), from which missile and motor designers would select a composition to optimize, for example, burn-out velocity ($V_{BO}$). In each of these compositions, an exact volume of binder/plasticizer has been exchanged, with no other changes. As indicated in FIG. 2, the density-impulse of the HTPB/DOA system is less than the other systems (PEG in FIG. 4; HTPE in FIG. 6; and PCL in FIG. 8), which all contain dissolved CL-20. Other than HTPB/DOA, all of these compositions contain dissolved CL-20 and should be high regression-rate compositions, in which their burn rate exceeds the current State-Of-The-Art. These compositions also are less sensitive to changes in stoichiometry than the HTPB system, which may be of benefit for performance-optimization. Please note, the HTPB/DOA binder system yields a higher maximum Isp than do any of the high regression-rate candidates. However, it also should be noted that rocket motors for generally tactical missile systems are volume-limited. Hence, unless the propellant application is for a weight-limited motor (e.g., an upper-stage), then density-impulse is an appropriate performance figure of merit for selection.

Compared to exact volumetric-analog HTPB-based propellants, some advantages are as follows. The binder systems include a soluble energetic additive to give a rocket motor designer greater flexibility of energy management (i.e., less highly-convoluted propellant surface-to-volume relationships). Concomitantly, higher propellant charge structural margins result from the new propellants by making available a greater fraction of the available combustor volume for propellant storage (i.e., total energy content). The binder systems, including a soluble energetic additive, give the propellant formulator additional degrees of freedom in achieving high linear burning-rates. Propellants are materials that, by design, burn layerwise, normal to the burning surface. Their rates of surface regression are governed by their respective thermal responsiveness. In conventional HTPB/AP systems (Class 1.3) burning-rates may be accelerated to a limited degree via ultra-fine (i.e., high surface-to-volume) AP and nano-sized combustion catalysts. The high specific-surfaces of these constituents cause processability difficulties in high-performance systems as one seeks to use as little liquid binder as possible for such compositions. Nano-phase metallic fuels aid in rate acceleration because, as with combustion catalysts, these materials may locate the flame-front (and its intense radiant-energy source) closer to the decomposing-but-uncombusted surface of the propellant. However, the conventional HTPB binder remains relatively unresponsive to the thermal flux. In contrast, a significant feature of the invented binder systems include a soluble energetic additive, which are not only thermally-responsive to radiant (and convective) processes, but also to conductive heat-transfer mechanisms, which are the most efficient of all mechanisms. This mechanism may be enhanced by the use of conductive metallic fuels in the form of whiskers, wires, staples, and/or flakes, and in combinations. In concert with combustion catalysts and/or nano-phase metals, these materials may be utilized as heat-conduction "antennas," which reach into the flame and conduct heat below the burning surface, thereby involving a greater volume of propellant per unit of time in the decomposition process preliminary to ignition and burning. This status was formerly achieved in extremely-high burning-rate propellants (e.g., as for interceptor missiles), but at a cost that these compositions are Class 1.1 (i.e., mass-detonability, and hence are unacceptable for shipboard operations).

The binder systems including a soluble energetic additive increase the thermochemical density-impulse of the compositions (an important factor for tactical systems). The binder systems including a soluble energetic additive decrease the parasitic-mass of the combustor (and hence the missile) because smaller pressure-vessels are required for the smaller, more energy-dense propellant volume. The binder systems including a soluble energetic additive extend the Service-Life (e.g., long-term life) of rockets employing such binder systems. One possible reason for the extended Service-Life, as mentioned above, is that at the higher available burning-rate, a less highly-convoluted propellant surface-to-volume relationship may be needed to achieve the necessary energy-management for the rocket's mission. This characteristic, in turn, may mitigate or eliminate requirements for stress-risers (e.g., strut-roots or internal corners) in the propellant charge geometry, which can extend the time during which sufficient propellant strain-capability still exists to preclude structural failure (e.g., cracking).

Actual Examples

As indicated in FIGS. 9-16, provided are Iso-plots of $Fe_2O_3$-catalyzed model compositions. Experimental control of ballistic catalyst level indicated a decomposition rate of Ammonium Perchlorate (AP, NH4CLO4) was catalyzed by Ferric Oxide ($Fe_2O_3$). With each binder system, Ferric Oxide was substituted for an equal volume of AP. All model compositions were Iso-Volumetric, the Ferric Oxide catalyst level for each was adjusted in proportion to the volume fraction of AP. For each catalyzed model composition, the Ferric Oxide was chosen to be 0.00375 volume-percent of the AP level in the un-catalyzed model composition. On an Iso-Volumetric basis, it was indicated that the worst maximum Density-Impulse performance (i.e., energy-density) of all the novel propellant compositions containing CL-20 dissolved in the Binder exceeds the best Density-Impulse performance of the compositions based upon the SOTA HTPB/DOA Binder. This outcome is highly-desirable though not central to the initial purpose of the invention, which is energy management, that is, high propellant burning rate.

It is to be understood that the foregoing description and specific embodiments are merely illustrative of the best mode of the invention and the principles thereof, and that various modifications and additions may be made to the invention by those skilled in the art, without departing from the spirit and scope of this invention, which is therefore understood to be limited only by the scope of the appended claims.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. A composition for a high burning-rate solid rocket propellant, consisting essentially of:

a plasticizer;

a soluble energetic additive being dissolved in a plasticizer;

a binder being dissolved with the soluble energetic additive in solution;

a metallic fuel; and an oxidative fuel, wherein said composition includes a tactical Class 1.3 hazard rating, and a linear regression rate substantially equivalent to a tactical Class 1.1 hazard rating of a solid rocket propellant;

a cure catalyst;

a combustion catalyst for facilitating burning;

a curing agent;

an antioxidant;

a bonding agent;
a processing agent;
and
a heat-conducting element,
wherein said plasticizer is an inert liquid plasticizer,
wherein said inert liquid plasticizer is a non-nitroplasticizer selected from at least one of TA (triacetin), DOP (dioctyl phthalate), DOA (dioctyladipate), DOM (dioctylmaleate), DBP (dibutylphthalate), and adiponitrile,
wherein said heat conducting element is selected from at least one of whiskers, wires, staples, spheres, flakes, and nano-phase particles, and
wherein the combustion catalyst is selected from one of copper chromite, nano-Fe2O3, nano-AL ferrocenes, and carboranes.

2. The composition, as claimed in claim 1, wherein the composition includes a moderate sensitivity limit to Drop-Weight Impact, Sliding-Friction and Electrostatic Discharge, for acceptable safe handling on vessels.

3. The composition, as claimed in claim 1, wherein the soluble energetic additive is selected from at least one of CL-20 (hexanitrohexaazaisowurtzitane), octanitrocubane, RNX (hexahydrotrinitrotriazine), RDX (hexahydro-1,3,5-trinitro-1,3,5-triazocine), ADN (ammonium dinitramide), ADNAZ (N-acetyl-3,3-dinitroazetine), and TNAZ (1,3,3-trinitroazetidine).

4. The composition, as claimed in claim 1,
wherein the metallic fuel is selected from at least one of whiskers, wires, staples, spheres, flakes, and nano-phase particles.

5. The composition, as claimed in claim 1, wherein said metallic fuel is selected from at least one of aluminum, iron, magnesium, zinc, boron, tungsten, zirconium, titanium, copper, chromium, molybdenum, and metal oxides.

6. The composition, as claimed in claim 1, wherein said oxidative fuel is selected from at least one of AP (ammonium perchlorate), AN (ammonium nitrate), HAN (hydroxyl-ammonium nitrate), alkali metal perchlorates, alkali metal nitrates, and hydrazine.

7. The composition, as claimed in claim 1, wherein said binder is selected from one of hydroxyl terminated polybutadienes, hydroxyl terminated aliphatic polyesters, and hydroxyl terminated aliphatic polyethers.

8. The composition, as claimed in claim 1, wherein said curing agent is selected from one of a diisocyanate compound, a polymeric isocyanate compound and an epoxy compound.

9. The composition, as claimed in claim 1, wherein said cure catalyst is selected from one of a liquid dialkyl tin catalyst and a delayed quick cure catalyst triphenyl bismuth.

10. The composition, as claimed in claim 1, further comprising an opacifier, and a colorant to visually illustrate homogeneity.

11. The composition, as claimed in claim 7, wherein said hydroxy terminated aliphatic esters are selected from one of polycaprolactone and polycaprolactone containing copolymers.

12. The composition, as claimed in claim 7, wherein said hydroxy terminated aliphatic polyethers is selected from at least one of polyethylene glycol, polypropylene glycol, polytetramethylene glycol, polyisobutylene glycol, polybutylene glycol, and polymeric combinations of glycols.

13. The composition, as claimed in claim 1, wherein said binder is a hydroxyl terminated polyether glycol cured with a polymeric isocyanate,
wherein said soluble energetic additive is CL-20,
wherein said metallic fuel is aluminum in powder and flake form, and
wherein said oxidative fuel is AP.

14. A composition for a high burning-rate solid rocket propellant, consisting of:
a plasticizer;
a soluble energetic additive being dissolved in a plasticizer;
a binder being dissolved with the soluble energetic additive in solution;
a heat-conducting element;
a metallic fuel;
an oxidative fuel;
a cure catalyst; a curing agent;
an antioxidant;
a bonding agent;
a processing agent;
an opacifier;
a colorant for visually illustrating homogeneity;
and
a combustion catalyst for facilitating burning,
wherein said plasticizer is an inert liquid plasticizer,
wherein said composition includes a predetermined thermochemical energy density and a predetermined chemical kinetic rate of regression,
wherein said inert liquid plasticizer is a non-nitroplasticizer selected from at least one of TA (triacetin), DOP (dioctyl phthalate), DOA (dioctyladipate), DOM (dioctylmaleate), DBP (dibutylphthalate), and adiponitrile,
wherein said heat conducting element is selected from at least one of whiskers, wires, staples, spheres, flakes, and nano-phase particles, and
wherein the combustion catalyst is selected from one of copper chromite, nano-Fe2O3, nano-AL ferrocenes, and carboranes.

* * * * *